US005091672A

United States Patent [19]

Below

[11] Patent Number: 5,091,672

[45] Date of Patent: Feb. 25, 1992

[54] SHIELD FOR ALIGNING A GROUND ELECTRODE OF A SPARK PLUG IN A CYLINDER HEAD

[75] Inventor: Matthew B. Below, Findlay, Ohio

[73] Assignee: Allied-Signal Inc., Morristown, N.J.

[21] Appl. No.: 543,917

[22] Filed: Jun. 26, 1990

[51] Int. Cl.[5] ..... H01T 13/08; H01T 13/00; F02P 13/00

[52] U.S. Cl. ..... 313/143; 313/141; 313/142; 123/169 R

[58] Field of Search ..... 313/141, 142, 143, 11.5; 123/169 EL, 169 PA, 169 PH, 169 R

[56] References Cited

U.S. PATENT DOCUMENTS

| | | | |
|---|---|---|---|
| 1,314,129 | 8/1919 | Crowther | 313/143 |
| 4,484,101 | 11/1984 | Ibbott | 313/142 |
| 4,810,929 | 3/1989 | Strumbos | 313/143 |
| 4,859,900 | 8/1989 | Kasai | 313/143 |
| 4,989,557 | 2/1991 | Penney | 123/169 |

*Primary Examiner*—Donald J. Yusko
*Assistant Examiner*—Nimeshkumar D. Patel
*Attorney, Agent, or Firm*—Leo H. McCormick, Jr.; Ken C. Decker

[57] ABSTRACT

A spark plug for use in an internal combustion engine having a insulator with a cylindrical body that surrounds a center electrode. The cylindrical body has a first diameter section separated from a second diameter section by a shoulder. A sleeve that surrounds the second diameter has an integral base that is positioned a fixed distance from the tip of the center electrode by the engagement of a flange on the sleeve with shoulder on the cylindrical body. A radial tab that extends from the sleeve is located in a slot in a head on a combustion chamber of an internal combustion engine to establish the position of a ground electrode defined by the base in the combustion chamber. An end nut that surrounds the first diameter and engages the flange to locate and position the spark plug within the combustion chamber.

6 Claims, 2 Drawing Sheets

SHIELD FOR ALIGNING A GROUND ELECTRODE OF A SPARK PLUG IN A CYLINDER HEAD

BACKGROUND OF THE INVENTION

This invention relates to a spark plug having a shield which aligns either a single or a multiple ground electrode within a combustion chamber to aid in having substantially identical operational conditions in each cylinder of an internal combustion engine.

Spark plugs, such as disclosed in U.S. Pat. No. 2,899,479, having a protruded tip which extends into a combustion chamber and which are cooled by gases that enter the combustion chamber which operate in a satisfactory manner under most driving conditions. The exact location of the ground electrode in the combustion chamber has an effect on the effectiveness of cooling effect of such gases. To provide for the optimum effect of such cooling, the relationship between the ground electrode and the position of the threads on the shell of the spark plug and in the head of the combustion chamber must be matched to assure each cylinder has the same capability of responding to the combustion of fuel in its corresponding combustion chamber. When spark plugs are placed in high performance engines such as in race cars, the plugs are sorted and matched to assure that the position of the ground electrode on the spark plug in each combustion chamber is identical. However, when vehicles are mass produced the time and effort involved in the sorting and matching does not occur.

In an effort to provide for better combustion and reduce the emission of noxious gases into the atmosphere as required by the Clean Air Act of 1986 in the United States, the valves in some engines have increased in size to allow for a more controlled and efficient exhaust of gases from a combustion chamber. Unfortunately, the increase in size of the valves had resulted in a decrease in the size of spark plugs. The decrease in size of the spark plugs results in a decrease in the inside diameter of the metal bore of the spark plug which effectively reduces the ability of a spark plug to resist carbon build up or deposits on the spark plug. Carbon deposits on a spark plug may reduce the ignition efficiency and result in an increase in the creation of environmental pollutants. In addition, carbon build up may cause shunt firing due to the close proximity of the inside of the bore.

SUMMARY OF THE INVENTION

The spark plug disclosed by the present overcomes the problems of the prior art by assuring that the ground electrode is always aligned in a set position and the likelihood of shunt firing due to carbon build up has been reduced by increasing the size of the opening to the combustion chamber and replacing the shell with a shield. In the spark plug of this invention, a center electrode is surrounded by an insulator, a shield includes a sleeve which surrounds a portion of the insulator, a base integral with the sleeve is positioned a fixed distance from the center electrode to define a ground electrode and an end nut, that surrounds the center electrode, engages the sleeve to locate and seal the spark plug in the opening in a head of a combustion chamber of an internal combustion engine. The sleeve has a radial tab that is located in a slot in the head to position the ground electrode in the combustion chamber in alignment within the combustion chamber to deflect gas particles supplied to the combustion chamber and reduce the build up of carbon particles on the center electrode.

An advantage that this invention offers is the positive alignment of the ground electrode in a combustion chamber through the locating of a tab in a slot in the head of a combustion chamber.

Another advantage that this invention offers is the use of an end nut to affix and seal the spark plug in a head of a combustion chamber.

It is an object of this invention to provide a spark plug with shield means to align the ground electrode and deflect gas particles supplied to the combustion chamber away from the ground and center electrodes to reduce carbon build up thereon.

These objects and advantages should be apparent from reading this specification while viewing the drawings.

BRIEF DESCRIPTION OF THE DRAWINGS

FIGS. 1 and 9 illustrates a spark plug 18 made according to the principles of this invention located in an opening 24 in a head 12 of a combustion chamber 20 of an internal combustion engine. An end nut 16 having threads 14 that engage corresponding threads in head 12 engage the spark plug 18 to locate ground electrode 26 in the combustion chamber 20. An intake valve 32 located in head 12 allows incoming fuel and air to flow past seat 30 and around ground electrode 26 on spark plug 18 on its way to combustion chamber 20. As the fuel and air flow around the ground electrode 26 heat may either be removed or the ground electrode 26 may be positioned to deflect the incoming fuel and air away from the tip 34 of the center electrode 36 to retain heat and prevent the build up of carbon deposits depending on the optimum operation characteristics of the internal combustion engine.

Figure 1:
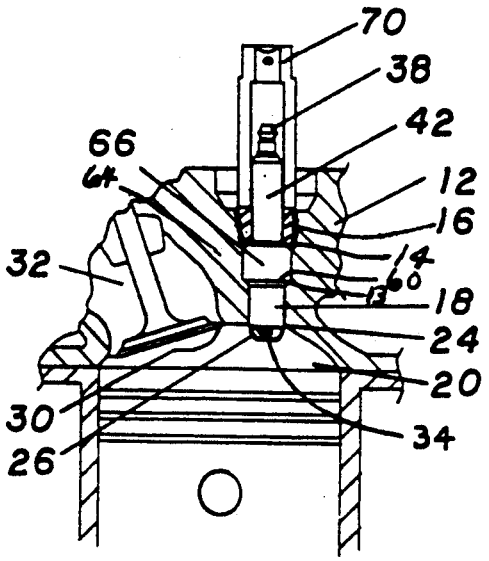
FIG. 1 is a sectional view of a combustion chamber of an internal combustion engine showing a relationship between an intake valve and a spark plug made according to the principles of this invention.
Figure 2:
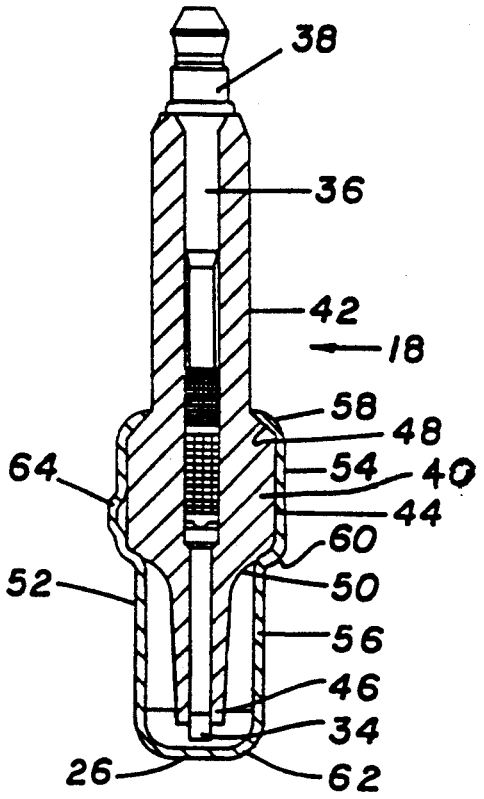
FIG. 2 is an enlarged view of the spark plug shown in FIG. 1.
Figure 3:
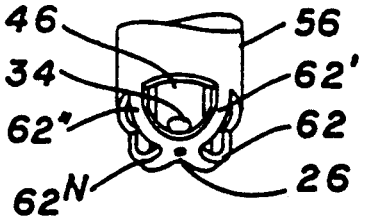
FIG. 3 is a perspective view of the tip end of the spark plug shown in FIG. 2.
Figure 5:
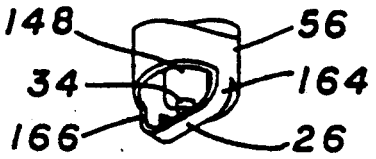
FIG. 5 is a perspective view of the tip end of the spark plug shown in FIG. 4.

The spark plug 18 which is shown in more particular detail in FIGS. 2 and 3 includes a conventional center electrode 36 with a terminal end 38 and tip end 34. An alumina insulator 40 which surrounds the center electrode 36 has first diameter section 42, a second diameter section 44 and a third diameter section 46. A first shoulder 48 forms a tapered and smooth transition between the first diameter section 42 and the second diameter section 44 and a second shoulder 50 form a tapered and smooth transition between the second diameter section 44 and the third diameter section 46. A metal shield 52 had a cylindrical body with a first diameter section 54 concentric to the second diameter 44 of the insulator 40 and a second diameter 56 that is approximately the same diameter as opening 24 in the head 12. A flange 58 that extends from the first diameter 54 of the shield 52 engages the first shoulder 48 on the insulator 40 and a frustoconical section 60 between the first and second diameters 54 and 56 on the shield engages the second shoulder 50 to define a space relationship between the ground electrode 26 and tip 34 on the center electrode 36.

As best shown in FIG. 3, ground electrode 26 which is an integral part of the shield 52, has a plurality of legs 62, 62', 62'' and 62$^n$. The legs 62, 62', 62'' and 62$^n$ are located to either direct the stream of incoming fuel and air toward or away from the tip 34 of the center electrode 36. The exact position of the legs 62, 62', 62'' and 62$^n$ within the combustion chamber 20 is determined by the radial projection 64 that extends from the first diameter 54 of the shield 52 and a slot 66 in opening 24 in head 12. The slot 66 which is placed in the head 12 during the manufacture of the head 12 provides the orientation for the ground electrode 26 which can be duplicated without special sorting and matching of individual spark plugs in the various cylinders of an internal combustion engine.

Once shield 52 is Placed in opening 24 and radial projection 64 is located in slot 66, end nut 16 is placed on the first diameter 42 of the insulator 36. Socket tool 70 engages the end nut 16 and torque is applied to bring the end nut 16 into engagement with flange 58 and frustoconical section 60 into engagement with seat 13 on head 12 to seal opening 24. By eliminating the threads from the shield 52 or the small diameter the metal shell as is common with the prior art and using a separate end nut 16 to affix the spark plug 18 in the head, the possibility of cross threading the threads 14 with the head 12 has been reduced. In addition, some cost savings may result for the reuse of the end nut 16 when the spark plug 18 is replaced after a period of use in the internal combustion engine.

In the embodiment of the spark plugs shown in FIGS. 4, 5, 6 and 8 wherein components are identical, the same numbers are used to identify the specific components.

Figure 4:
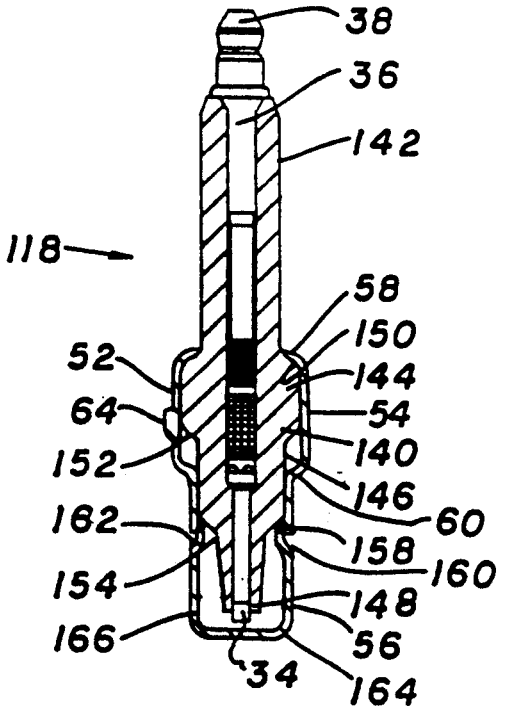
FIG. 4 is a sectional view of a secondary embodiment of the spark plug of FIG. 1 having a sealing gasket between the shield and insulator to prevent gases from being communicated from the combustion chamber to the surrounding environment.

In the spark plug 118 shown in FIG. 4, in an effort to increase the transfer of heat away from the area of the tip 34 of the center electrode 36 to the head 12, a greater volume of material in the insulator is placed below the first shoulder 50 of insulator 40 in FIG. 2 to produce a different insulator 140 as illustrated in FIG. 4. In this spark plug 118, the insulator 140 has a first diameter 142, a second diameter 144, a third diameter 146 and a fourth diameter 148 with a corresponding first shoulder 150, a second shoulder 152 and a third shoulder 154 separating the various successive diameters. The first diameter 54 of the shield 52 is concentric with and rests on diameter 144 of the insulator 140 while the second diameter 56 of the shield 52 rests on diameter 146. A gasket 158 located in the shield 52 is held against shoulder 154 on the insulator 140 by a plurality of tabs 160 and 162 that are stamped in the shield 52. The gasket 158 also forms a barrier which prevent the communication of gases in the combustion chamber 20 from reaching the third diameter 146 of the insulator 140. The integral ground 26 that extends from sleeve of the shield 52 has a plurality of legs 164 and 166. The plurality of legs offer a corresponding plurality of electrical flow paths between the tip 34 of the center electrode 36 and the head 12. In addition, by placing a greater surface area of the shield 52 on the insulator 140, heat can be carried away to the head 12 in a more effective manner.

Figure 6:
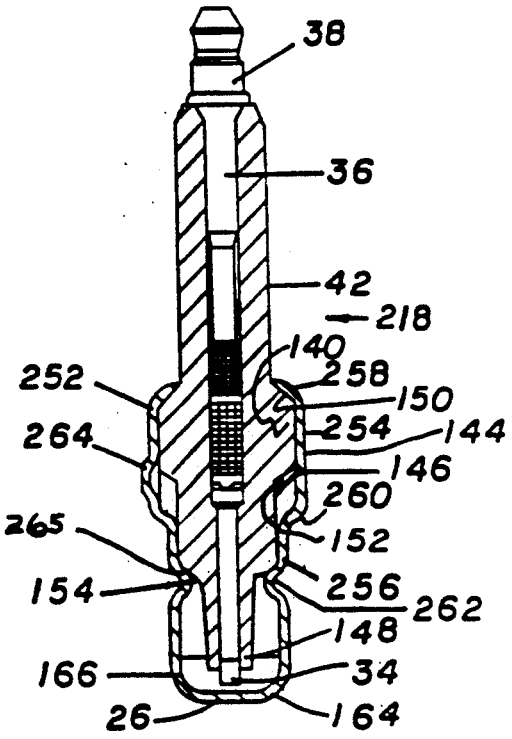
FIG. 6 is a sectional view of a further embodiment of the spark plug of FIG. 1 having a shield that is fixed to the insulator by a plurality of flanges.

The spark plug 218 shown in FIG. 6 is identical to the spark Plug 118 shown in FIG. 4 with the exception of the shield 252. Shield 252 includes a sleeve with first diameter 254 and a second diameter 256 separated by a frustoconical section 260 and an integral base that forms ground electrode 26. At the same time flange 258 is placed on shoulder 150, a groove 262 is placed in the second diameter 256 to fix the space relationship between ground electrode 26 and tip 34 on the center electrode 36. In addition, wall 265 of groove 262 engages shoulder 154 on insulator 140 to form a first seal for the shield 252 and insulator 140. On insertion of spark plug 218 in opening 24 of a head 12, shoulder 260 engages the head to form a seal for opening 24 as end nut 16 is torqued by a force applied to tool 70. Radial projection 264 which is located in slot 66 aligns the ground electrode 26 in a manner desired to achieve results as previously determined for the internal combustion engine.

Figure 7:
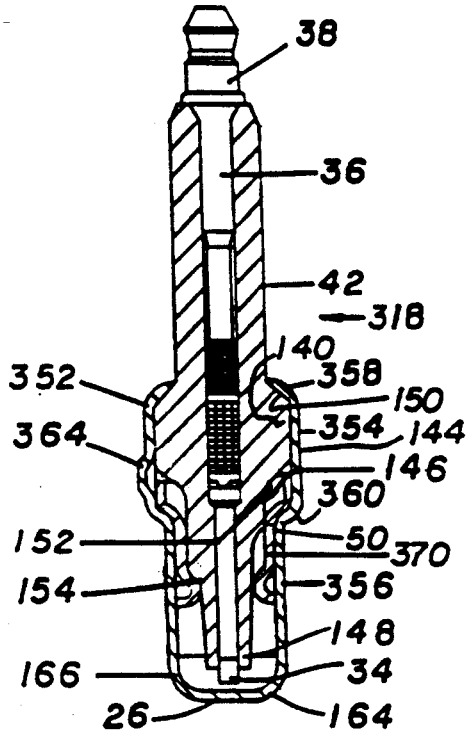
FIG. 7 is a sectional view of a still further embodiment of the spark plug of FIG. 1 having an insert that cooperates with the shield and insulator to define a space relationship between the tip of the center electrode and ground electrode that is integral with the shield.

The spark plug 318 shown in FIG. 7 is identical to spark plug 118 illustrated in FIG. 4, with the exception of shield 352 and an insert 370. Shield 352 includes a sleeve with a first diameter 354 and a second diameter 356 separated by a frustoconical section 360 and an integral base which form ground electrode 26. Insert 370 has a cylindrical body with a first portion that is concentric to the frustoconical section 360 of shield 252 and a second portion that is concentric to shoulder 154 on insulator 140. When flange 358 is sealed on shoulder 150 and shoulder 154 is sealed on insert 370, the space relationship between ground electrode 26 and tip 34 is established. On insertion of spark plug 318 in opening 24, radial projection 364 is located in groove 66 to position ground electrode 26 in a desired manner. Application of torque to end nut 16 by tool 70, brings the frustoconical section 360 into engagement with head 12 to seal opening 24. During operation of the internal combustion engine, heat generated in the combustion chamber 20 and transmitted into insulator 142 is better carried away from the center electrode 36 by the insert 370 since more area is in contact with the insulator 142.

Figure 8:
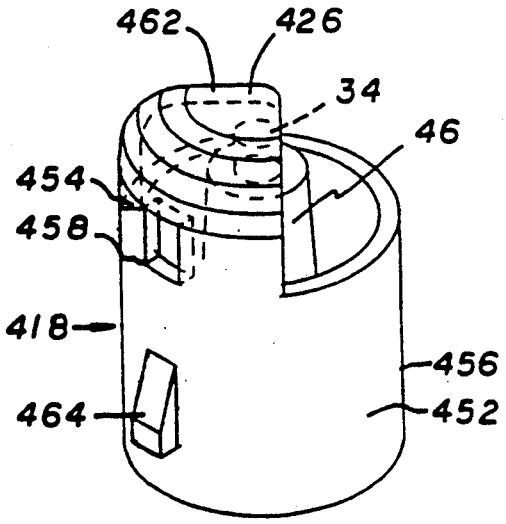
FIG. 8 is a perspective of the ground electrode of another shield for deflecting gas particles away from the center electrode to reduce carbon build up that may cause misfiring during the operation of a spark plug in an internal combustion engine.
Figure 9:
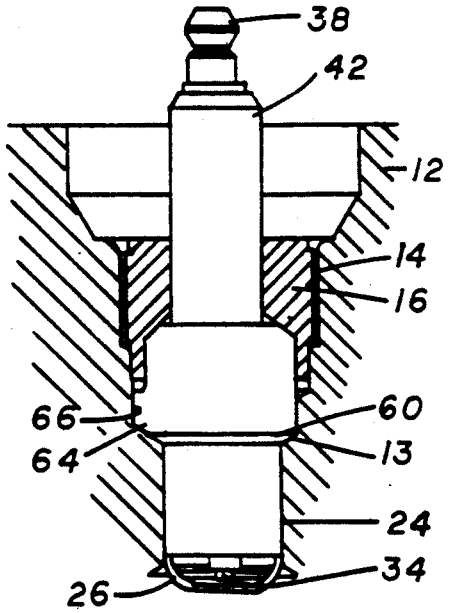
FIG. 9 is an enlarged view of the spark plug of FIG. 1 located in the head of an engine. cl DETAILED DESCRIPTION OF THE INVENTION

In the spark plug 418 shown in FIG. 8, the ground electrode 426 has a single leg 462 that which is an semi-arcuate extension 454 of the second diameter 456 of shield 452. The arcuate extension 454 has an opening 458 to allow the communication of fuel and air mixture to be presented to the center electrode 34. The semi-arcuate extension 454 covers one quarter of the circumference of shield 452. The radial projection 464 which is aligned with opening 458 when positioned on slot 66 in the opening 24 in head 12 should be sufficient to deflect the fuel and air in a manner to reduce carbon build up on the center electrode 34 and ground electrode 426 and thus reduce the possibility of misfiring during the operation of the engine.

It is anticipated that by selecting the proper orientation of the ground electrode 26 for a spark plug, as disclosed in this invention in, a more effective and efficient combustion of the fuel will occur for an internal combustion engine without misfiring.

I claim:

1. A spark plug located in an opening in a head in a combustion chamber of an internal combustion engine, comprising:

a center electrode having a solid cylindrical body with a tip and a terminal;

an insulator surrounding said center electrode having a substantially cylindrical body with at least first, second and third diameter sections separated by first and second shoulders;

a shield surrounding said insulator having a sleeve member with a first annular section separated from a second annular section by a frustoconical section and a base section, said first annular section having a flange that engages said first shoulder on said insulator and said frustoconical section engaging said second shoulder to position said base section at a fixed dimension from said tip of the center electrode, said base section forming a ground electrode, said shield having a radial projection located in a slot in the head to fix the location and position of said base section within the combustion chamber; and an end nut surrounding said first diameter of said insulator having threads that are matched with threads in said opening of the head, said end nut engaging said flange to bring and hold said frustoconical section of said shield into engagement with said head to establish an electrical ground between said shield and head while at the same time sealing said combustion chamber from the surrounding environment.

2. The spark plug as recited in claim 1 wherein said shield has a plurality of openings in said base section, said plurality of openings being aligned by said radial projection to permit fuel presented to the combustion chamber to be selectively sprayed on to the tip of said center electrode.

3. The spark plug as recited in claim 1 wherein said insulator further includes:

a fourth diameter section separated from said third diameter section by a third shoulder.

4. The spark plug as recited in claim 3 wherein said spark plug further includes:

a gasket located in said second diameter of said sleeve; and stop means on said second diameter section of said sleeve for urging said gasket toward said third shoulder to form a barrier to prevent communication of gases from the combustion chamber.

5. The spark plug as recited in claim 4 wherein said spark plug further includes;

insert means having a contour that substantially matches said frustoconical section on said sleeve and said third shoulder on said insulator, said insert engaging said insulator to define the space relationship between said tip and ground electrode while at the same time conducting heat from the insulator to said head.

6. The spark plug as recited in claim 3 wherein said base section is a semi-arcuate extension of said second annular section, said semi-arcuate extension having an opening which permits some fuel to be communicated to while deflecting the majority of fuel away from the center electrode to reduce the creation of carbon deposits on the center and ground electrodes.

* * * * *